US006582199B1

(12) United States Patent
Volkmann

(10) Patent No.: US 6,582,199 B1
(45) Date of Patent: Jun. 24, 2003

(54) MULTI-STAGE EJECTOR PUMP

(76) Inventor: Thilo Volkmann, Zum Vulting 12, D-59514 Welver-Schwefe (DE)

( * ) Notice: Subject to any disclaimer, the term of this patent is extended or adjusted under 35 U.S.C. 154(b) by 0 days.

(21) Appl. No.: 09/856,111

(22) PCT Filed: Sep. 20, 2000

(86) PCT No.: PCT/EP00/09208

§ 371 (c)(1),
(2), (4) Date: Jun. 4, 2001

(87) PCT Pub. No.: WO01/21961

PCT Pub. Date: Mar. 29, 2001

(30) Foreign Application Priority Data

Sep. 20, 1999 (DE) ..... 299 16 531 0 U

(51) Int. Cl.[7] ..... F04B 5/00; F04B 5/46; F04B 5/44; F04B 5/48

(52) U.S. Cl. ..... 417/178; 417/179; 417/198; 417/182

(58) Field of Search ..... 417/178, 179, 417/198, 182

(56) References Cited

U.S. PATENT DOCUMENTS 4,466,778 A * 8/1984 Volkmann ..... 417/174
4,759,691 A * 7/1988 Kroupa ..... 417/174
4,880,358 A * 11/1989 Lasto ..... 417/174
5,228,839 A * 7/1993 Peterson et al. ..... 417/174
5,683,227 A * 11/1997 Nagai et al. ..... 417/174

FOREIGN PATENT DOCUMENTS

DE 44 91 977 6/1997
FR 700 651 3/1931

* cited by examiner

*Primary Examiner*—Charles G. Freay
*Assistant Examiner*—Timothy P. Solak
(74) *Attorney, Agent, or Firm*—Fay, Sharpe, Fagan Minnich & McKee

(57) ABSTRACT

A multi-stage ejector pump having an ejector nozzle system with the nozzles situated coaxially behind each other and axially set apart from each other by a spaced distance. The ejector a nozzle system is made up of a set of individual nozzles and nozzle spacers. The ejector nozzle system can be sealingly pushed into a nozzle-receiving shaft of a housing element. The housing wall is interrupted in the area between adjacent nozzles to provide a fluid connection to suction chambers. Each individual nozzle is provided with support elements on its outer periphery. The support elements are axially set apart and provide tilt-free or low-tilt support in relation to the wall of the nozzle-receiving shaft. The aim of the invention is to provide a multi-stage ejector pump which has compact construction, interchangeable nozzles and a high degree of efficiency.

57 Claims, 3 Drawing Sheets

MULTI-STAGE EJECTOR PUMP

The present invention claims priority on International Patent Application Serial No. PCT/EP00/09208 filed Sep. 20, 2000, which in turn claims priority on German Patent Application Serial No. 299 16 531.9 filed Sep. 20, 1999.

The invention relates to a multi-stage ejector pump. More particularly, the invention relates to a multi-stage ejector pump having at least one housing element with at least one pressure gas intake opening, at least one suction gas intake opening, at least one exhaust gas opening, and at least one nozzle arrangement. The nozzle arrangement includes at least two nozzles (e.g., pressure gas nozzle, diffuser) positioned coaxially behind one another inside the housing element and axially spaced at distances from one another. The housing element includes a nozzle-receiving shaft having an essentially continuous shaft wall and at least one wall opening, an ejector step for the suction gas intake in the suction gas intake slit and the nozzles that equipped with at least one circumference sealing arrangement.

BACKGROUND OF THE INVENTION

For the simple manufacture of multi-stage ejector pumps, it is known in the art how to assemble the housing of the pump from individual parts, such as from a pump kit. Each part of the housing in the kit carries one of the nozzles in a transverse wall that intersects an interior space of the housing. If a multiple stage ejector pump is to be designed, this transverse wall of the housing may also carry several nozzles arranged side by side. Through the assembly of the parts of the housing, the pump is then ready for use. Here, installing the nozzles, e.g. by gluing them in or even by integrating the nozzle into the separating wall as a single part, is comparatively simple. However, many hermetic surfaces exist between the parts of the housing. The range of available designs for a compact pump arrangement are very limited. An ejector pump that is representative of the prior art for modular multi-stage pumps is disclosed in DE-C1-44 91 977, FIGS. 7 to 9.

There are also ejector pumps known, in which a continuous cast profile with inner separating walls is used, and the nozzles are installed in the individual separating walls angled to the axis of the profile through holes drilled in a terraced pattern. Most of the nozzles are located in the hollow spaces on both sides of the separating walls, which serve to distribute the gas. Although the above-mentioned hermetic surfaces are eliminated, adapting and tightening the nozzles is still difficult. Moreover, the compactness of such ejector pumps is not significantly better than the modular pumps mentioned above. For tight spaces, there are ejector pumps known with a compact design, in which the nozzles are pushed from different sides against a catch into a drilled hole in the housing to receive them. Due to such a design, ejector pumps of this kind can only be designed with one stage. It is not possible to interchange the nozzles.

Finally, there is a general multi-stage ejector that is known from DE 44 91 977, FIGS. 1 to 5, which is characterized in that a two-stage ejector nozzle system is designed as one piece and can be pushed into a nozzle-receiving shaft. In order to attain multi-stage properties, the one-piece axially designed nozzle body is connected with a suction opening by means of sections with a greater inside diameter. One of the limitations of using this type of pump design is that the manner of making the nozzles requires very costly shaping steps in the area of the undercut zones. Another limitation of this design is that only a cylindrical or conical course of the nozzle cross-sections located behind one another can be achieved. The supply of the pressure gas and the suction gas chamber are housed in flange-mounted components, which are connected with the housing body featuring the one-piece nozzle with screws, with the use of a large number of filigrane gaskets. The connection for the pressure gas and the connection for the suction gas are located in a lateral face arranged parallel to the nozzle channel inside the walls of the flange-mounted components of the housing. These gas connections face away from the nozzle axis at a right angle. The large number of additional sealing surfaces, in the area of the flange-mounted components of the housing makes this ejector pump prone to leaks. This risk is only slightly attenuated with the closed lateral walls of the housing base that run in a U shape along the nozzle configuration.

In view of the deficiencies of prior art ejector pumps, there is a need for a less costly ejector pump that has a compact design and is less prone to leakage during operation.

SUMMARY OF THE INVENTION

The principal problem to be solved by the present invention is to design a generic multi-stage ejector pump that is compactly constructed, includes interchangeable nozzles and has a high degree of effectiveness. To resolve the problems of prior art multi-stage pumps, there is provided a multi-stage ejector pump which includes at least one housing element. The housing element includes at least one pressure gas intake opening, at least one suction gas intake opening, at least one exhaust gas opening, and at least one nozzle arrangement. The nozzle arrangement, such as an ejector nozzle system, includes at least two nozzles (e.g., pressure gas nozzle and/or one or more diffusers) that are positioned coaxially behind one another inside the housing element and axially spaced at distances from one another. The ejector nozzles also includes an exhaust gas outlet opening, at least one pressure gas intake opening, and at least one suction gas intake slit between adjacent nozzles and an exhaust gas outlet opening. The housing element also includes a nozzle-receiving shaft (e.g., a drilled hole) having an essentially continuous shaft wall and at least one wall opening (e.g., connection opening). The housing element also includes a step for the suction gas intake in the suction gas intake slit. The nozzles on their outer circumference are equipped with at least one circumference sealing means. The ejector nozzle system is designed to be axially inserted into the nozzle-receiving shaft. The ejector nozzle system also includes a set of individual nozzle spacers. The nozzles are also equipped with support elements that are axially spaced for its tilt-free or low-tilt support in relation to the shaft wall when the nozzles are inserted into the nozzle-receiving shaft. At least one clamping means, such as a connection plate, is provided to axially clamp or hold in position the individual nozzles and the nozzle spacers in the nozzle-receiving shaft.

In one embodiment of the invention, the ejector nozzle system should consist of a set of individual nozzles (e.g., pressure gas nozzle, diffuser) and nozzle spacers, whereby the spacers leave open a space for the entry of gas between the adjacently spaced nozzles. As periodically referred to in this specification, the pressure gas nozzle and/or one or more diffusers of the ejector nozzle system are referred to as nozzles. The nozzles can be inserted into the nozzle-receiving shaft one after the another. By using this arrangement of nozzles, each of the nozzles can be shaped at both ends in a manner that will increase their performance. In addition, each individual nozzle has at least two support elements that are axially spaced to provide for a tilt-free or low-tilt support in relationship to the shaft wall. Only in this way is the design of individual nozzles with optimized performance possible, and which provides for the simple orienting of the nozzles to a common nozzle axis, without the need to glue the nozzles on to the nozzle-receiving shaft. While a press fit of the nozzle is conceivable, preferably O-rings are used as a means of sealing the outer circumference of each individual nozzle. The support elements can be cams that are distributed around the circumference of the nozzles, or something similar, but they can also be O-rings or similar means of sealing. The use of cams have the advantage of fulfilling a twofold function, since the cams serve as means of sealing at the same time as providing a tilt-free or low-tilt support. In order to position the nozzles and the nozzle spacers with precision, at least one means of clamping is provided. Thereby the nozzles with their nozzle spacers are axially clamped or held in position.

In another embodiment of the invention, the spacers can basically be provided on the housing element, for example in the form of steps in the nozzle-receiving shaft. However, according to the invention, because the spacers can be more simply manufactured and more easily adapted to the desired arrangement of nozzles, the spacers are preferably provided as separate or one piece one piece components. In addition, the spacers are preferably eccentrically positioned on the nozzles. The spacers, however designed, are inserted into the nozzle-receiving shaft. A particular high level of performance is attained when the spacers are equipped with slim catches or similar protrusions on one nozzle front end. It is preferable to provide only one single spacer of this kind. A preferred arrangement of the one or the several nose-shaped spacers is selected in such a way that, between two adjacent nozzles, the spacers are assigned to the nozzles in peripheral areas with low levels of flow, for example, on the side of the nozzles located opposite the gas entry side.

In another embodiment of the invention, the suction chambers are positioned parallel to the nozzle receiving shaft. The use of such a the suction chamber orientation allow for the suction chambers to be simply designed in a compact manner the housing. In accordance with this embodiment, there is preferably at least one drilled hole for gas suction. The drill hole is preferably designed as a drilled pocket hole. The drill hole includes O-rings on the outer circumference of the drill hole, and flap valves are provided to create a seal for the drill. The suction gas shaft is positioned parallel to the nozzle receiving shaft to reduce the number of sealing locations, while making the manufacture of the pump simpler and the arrangement of the gas feed and exhaust lines more compact.

In still another embodiment of the invention, the nozzle receiving shaft and the drilled hole for the suction gas both have a stepped change in diameter in the direction of the axis. This step change in diameter of the nozzle-receiving shaft and the drilled hole for the suction gas is advantageous in that the hermetically sealing O-rings can be inserted by sliding only along a short region of the shaft and near the final position of the O-rings along the wall of the shaft. In the area where the diameter of the steps is greater, contact with nozzles having smaller diameters can be eliminated.

In yet another embodiment of the invention, the compactness of the pump is further improved by providing a drilled hole for the suction gas that extends parallel to the nozzle-receiving shaft. The drilled hole for the suction gas provides a passageway to supply pressured gas to the pump. The axis of this drilled hole essentially and advantageously lies in parallel plane with the axis of the nozzle receiving shaft and the drilled hole for the suction gas. Using this design, the drill hole for the suction gas, the drill hole for the exhaust gas and the drill hole for the pressure gas are all parallel to the same longitudinal axis. As such, the suction gas, the exhaust gas and the pressure gas flow along parallel plane when entering or exiting the housing element of the multi-stage ejector pump. Due to this parallel planar arrangement of the drill hole for the suction gas, the drill hole for the exhaust gas and the drill hole for the pressure gas, a flat cubical block of light material or plastic can be developed as the housing element. This block of material of plastic may be created from drilling out of a solid blank or formed by an injection mold process. The parallel arrangement of the nozzle-receiving shaft with the suction gas shaft and/or the drilled hole for the pressure gas (pressure gas shaft) in a single housing block is of independent inventive significance.

In still yet another embodiment, prior art control valves can be used for the switching on and off of the vacuum function. In addition, control valves can also be used to control the drawing off of gas from the housing element. The prior art control valves are positioned in drilled holes that can run somewhat at a right angle through the drilled hole for the pressure gas and can extend into the nozzle receiving shaft. By this configuration for the control valves, a very short overall length of the ejector block is made possible. The control valves can be moved back and forth inside valve sleeves. The valve sleeves are set into the drilled holes for the control valves by means of O-rings and are clamped in their axis direction by a valve plate screwed on to the ejector block. The valve plate contains, in a manner that is known, electromagnetic pilot or servo valves, which create or interrupt a fluid connection between the pressure gas and the valve, thus pneumatically opening or closing the control valves.

In a further embodiment of the invention, the multi-stage ejector pump according to the invention can be used to produce a vacuum, for example for handling applications (conveying sheet metal press production lines for vehicle body parts, pick-and-place applications in plastic injection molding and the like). The multi-stage ejector pump is extremely compact and lightweight and can integrate functions in a simple manner (e.g., the electrical control of switching the vacuum on and off, the electrical control of switching the blowing off, and/or the monitoring of the level of the vacuum).

In comparison to known multi-stage compact ejectors, whose level of efficiency is, as a rule, between 0.4 and 0.7 parts suction air per part of applied pressure air, levels of efficiency of 1.2 to 2 parts suction air per part of applied pressure air can be attained with the invention. This is attained, on the one hand, because the multi stages, particularly two stages, of the ejector pump are simple to achieve, and, on the other hand, because of the possibility of shaping the valve cross-section to foster flow, despite the compact design. Because of the simpler construction of the ejector pumps according to the invention, vacuum pumps with varying performance levels can be made quickly and at low cost. Only the nozzle systems of the multi-stage pump of the present invention needs to be changed or be correspondingly set into the ejector block at hand. All parts are easily accessible and can be cleaned thoroughly, in the event performance diminished because dirt has been sucked in. Furthermore the fact that the ejector block can be separated from the nozzles and valves makes disassembly very simple, in the event it is taken off line.

In summary, the present invention pertains to an improved multistage ejector pump. The multi-stage ejector pump includes at least one housing element. The housing element includes at least one pressure gas intake opening, at least one suction gas intake opening, at least one exhaust gas opening, and at least one nozzle arrangement. The nozzle arrangement such as an ejector nozzle system, includes at least two nozzles (e.g., pressure gas nozzle and/or one or more diffusers) that are positioned coaxially behind one another inside the housing element and axially positioned from one another. The nozzle arrangement also includes an exhaust gas outlet opening, at least one pressure gas intake opening, and at least one suction gas intake slit between adjacent nozzles and an exhaust gas outlet opening. The housing element includes a nozzle-receiving shaft (e.g., a drilled hole) having an essentially continuous shaft wall and at least one wall opening (e.g., connection opening). The housing element also includes a stepped opening size for the suction gas intake in the suction gas intake slit. The nozzles on their outer circumference are equipped with at least one circumference sealing means, and the ejector nozzle system is axially insertable into the nozzle-receiving shaft. The ejector nozzle system also includes a set of nozzle spacers. The nozzles are equipped with support elements that are axially spaced to provide for tilt-free or low-tilt support in relation to the nozzle receiving-shaft and which support elements can be inserted into the nozzle-receiving shaft. At least one clamping means, such as a connection plate, is provided to axially clamp or hold in position the individual nozzles and the nozzle spacers in the nozzle receiving shaft.

In one additional aspect of the invention, the nozzle spacers, when the suction-gas intake slits between the nozzle front ends are released, are insertable between adjacent nozzles and can be inserted into the nozzle-receiving shaft.

In still another additional aspect of the invention, the spacers are shaped as slender noses or similar protrusions on one front end of a nozzle.

In yet another additional aspect of the invention, a single spacer is positioned in an area with low gas flow in the periphery area of the nozzles (e.g., eccentrically).

In still yet another additional aspect of the invention, a suction chamber is provided in a drilled hole for the suction gas and is positioned essentially parallel to the nozzle-receiving shaft.

In a further additional aspect of the invention, flap valves can be inserted into the drilled hole for the suction gas to form a hermetic seal.

In still a further additional aspect of the invention, the nozzle-receiving shaft and/or the drilled hole for the suction gas are made as drilled holes that are stepped or tiered in their diameter.

In still yet a further additional aspect of the invention, the nozzles and/or the flap valves can be inserted from a single side into a dead-end drilled hole (e.g., nozzle-receiving shaft and/or drilled hole for the suction gas).

In another additional aspect of the invention, a drilled hole for the pressure gas extends essentially parallel to the nozzle-receiving shaft.

In still another additional aspect of the invention, the housing element is shaped as a flat cubical block made of light material or plastic.

In yet another additional aspect of the invention, approximately at a right angle to the nozzle-receiving shaft, at least one drilled passage hole is provided to the drilled hole for the pressure gas and/or to the drilled hole for the suction gas.

In still yet another additional aspect of the invention, at least one control valve is placed in a drilled hole to receive a valve that connects the drilled hole for the pressure gas and the nozzle-receiving shaft and controls the flow of the pressure gas through the connection opening.

In a further additional aspect of the invention, a control valve includes a valve guide sleeve in the area of the drilled hole for the pressure gas.

In still a further additional aspect of the invention, the drilled hole for the pressure gas exhibits at least one bypass line between the inside of the drilled hole and the control valve that is controlled by a switch valve, in order to activate the control valve.

In yet a further additional aspect of the invention, the control valve exhibits a twofold effective tightening piston with differing piston surfaces on each of its sides.

The above mentioned components, as well as those claimed and those described in the embodiment, to be used according to the invention, are not subject to any special exception conditions, as to their size, shape, material selection and technical design, so that the selection criteria known in each particular area of application can find application in the claims, without exception.

BRIEF DESCRIPTION OF THE DRAWINGS

Further particularities, characteristics and advantages of the object of the invention can be derived from the description of the pertinent drawing which, by way of example, a preferred embodiment of a multi-stage ejector pump is represented; the drawings show.

DESCRIPTION OF A PREFERRED EMBODIMENT

Figure 1:
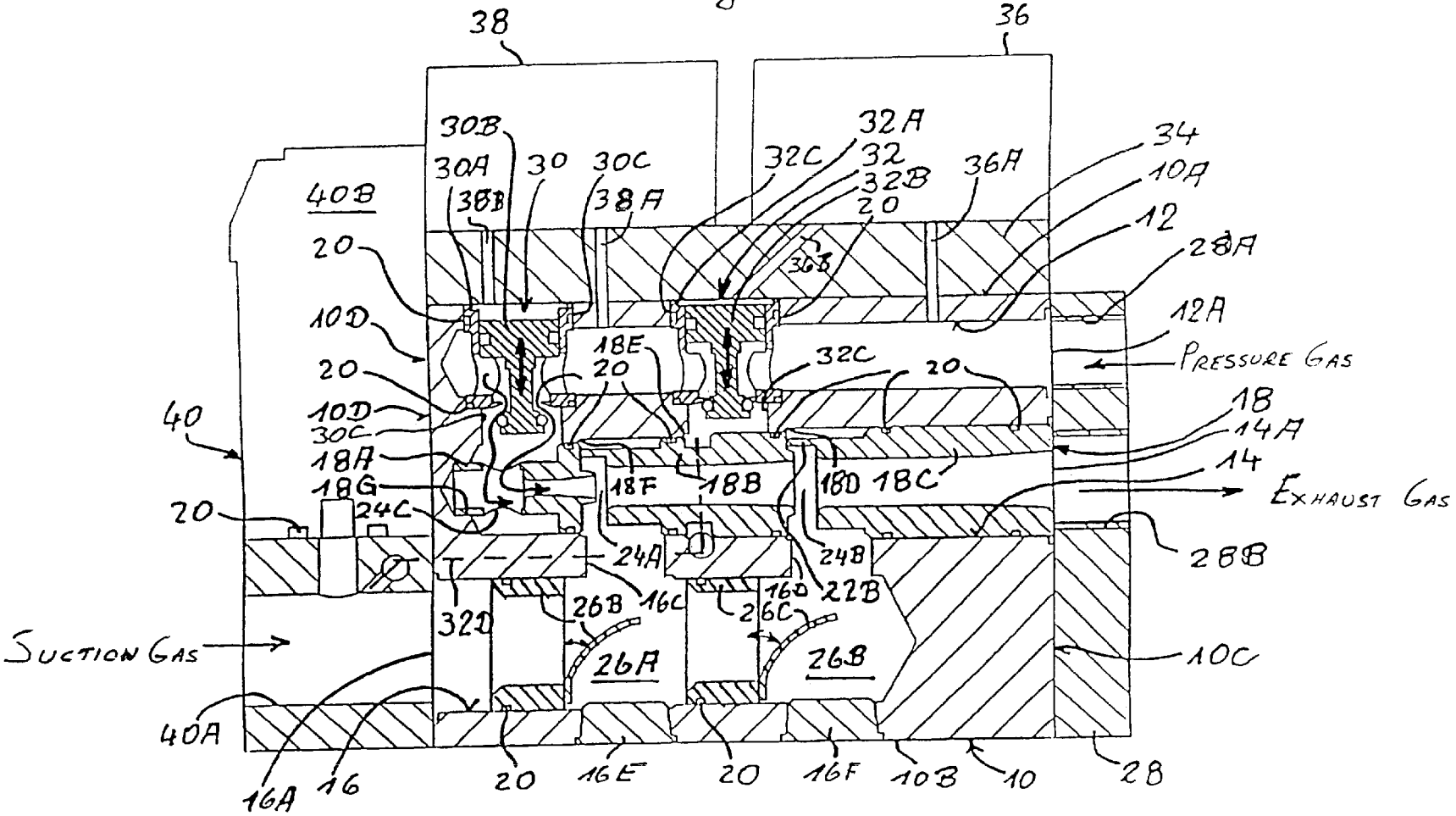
FIG. 1 is an axial cross-sectional view of a multi-stage ejector pump in accordance with the present invention.

Referring now to the drawings, wherein the showings are for the purpose of illustrating preferred embodiments of the invention only and not for the purpose of limiting the same, reference is first had to FIG. 1 shows a rectangular shaped ejector block made out of drilled whole aluminum in its basic form, serving as housing element 10. A drilled hole 12 for the pressure gas, which starts out from the front wall 10C (according to the drawing) and dead-ends shortly before the rear wall 10D opposite to it, forms a pressure gas intake opening 12A at its mouth end. Parallel to the axis of thrilled hole 12 for the pressure gas, the housing element 10 exhibits a nozzle-receiving shaft 14. The nozzle-receiving shaft is designed as a fourfold tiered drilled hole. The nozzle-receiving shaft exhibits one shaft wall 14A, which is only interrupted by drilled holes 30C, 32C, 16C and 16D, which drilled holes are axially set off-center and run transversely to the nozzle-receiving shaft. The nozzle-receiving shaft also ends up in the same front wall 10C of the ejector block, as does the drilled hole 12 for the pressure gas, and dead-ends shortly before the ejector block rear wall 10D opposite to front wall 10C. A third suction gas drilled hole 16 or suction shaft serving as a suction chamber is simply tiered and extends in the same plane as drilled hole 12 for the pressure gas and the nozzle-receiving shaft 14. The suction gas drill hole includes a mouth that is located opposite to the openings of the pressure gas intake opening 12A and exhaust gas outlet opening 14A in front wall 10A. The suction gas drill hole dead ends prior to front wall 10A and the mouth of the such gas drill hole serves as suction gas intake opening 16A.

Figure 2:
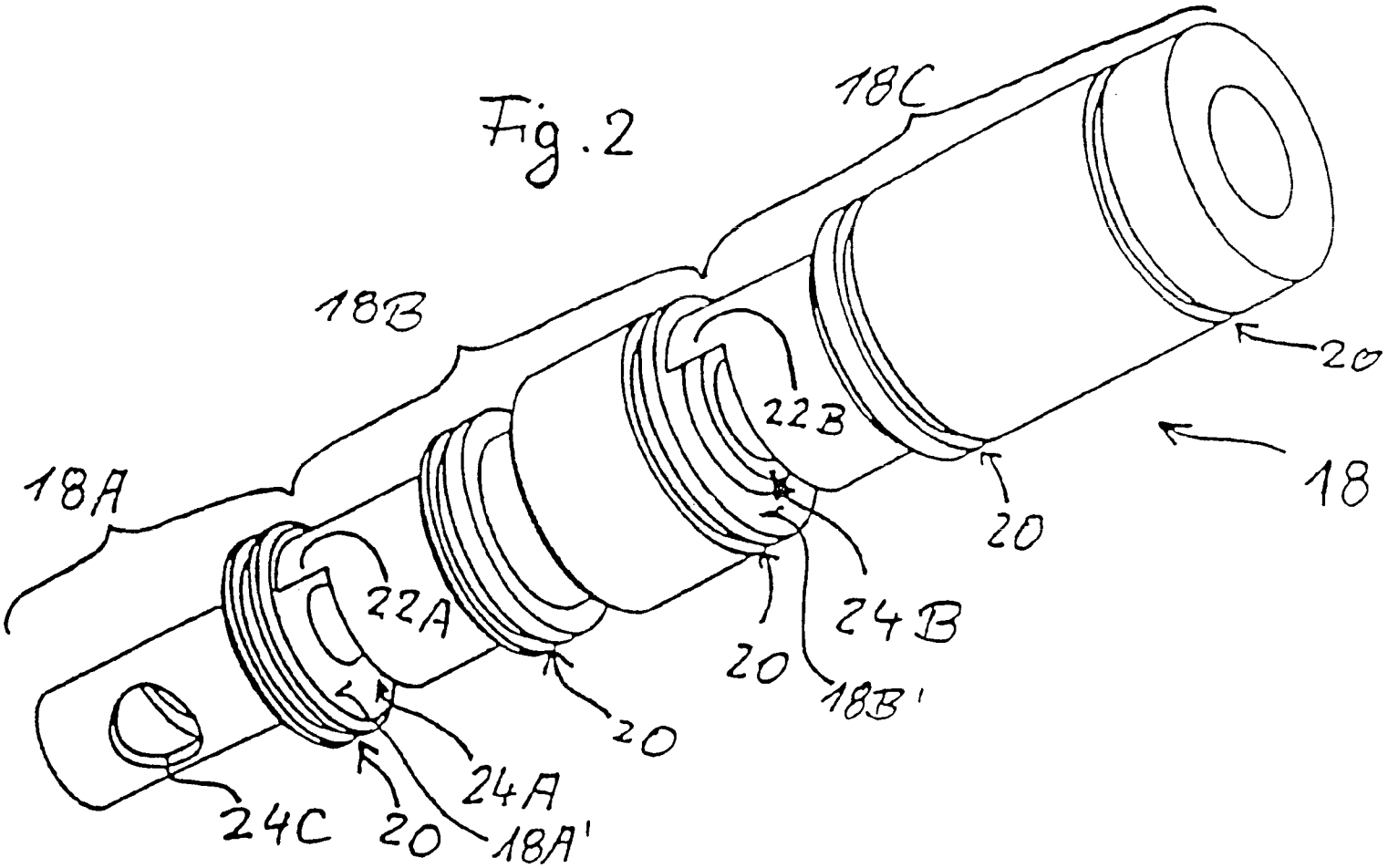
FIG. 2 is a perspective view of the nozzle system that is partially illustrated in FIG. 1; and, FIG. 3 is perspective view of a section of the control values in the open position that is partially illustrated in FIG. 1.

A three-piece ejector nozzle system 18 is insertable into nozzle-receiving shaft 14 and forms a hermetic seal with the nozzle-receiving shaft 14. As illustrated in FIG. 2, the three-piece ejector nozzle is comprised of a pressure gas nozzle 18A, and a first and second diffuser 18B and 18C. All three individual nozzles are supported so as to be tilt-secured against the shaft wall of the nozzle-receiving shaft 14. The diffusers are supported in at least two places at axially spaced locations along the length of the ejector nozzle. The gas nozzle and the diffusers are supported mainly by means of O-ring hermetic seals 20. The O-rings have been left out for the sake of visibility and only the O-ring grooves are shown. The O-ring hermetic seals form a light snug fit of the pressure gas nozzle 18A on the base of the drilled hole. Referring now to FIG. 1, through multiple gradations 18D, 18E, 18F and 18G in nozzle-receiving shaft 14, the pressure gas nozzle 18A and diffusers 18B and 18C of ejector system 18 can be inserted into the nozzle-receiving shaft 14 with little wear and tear. As shown in FIG. 2, pressure gas nozzle 18A and diffusers 18B and 18C are positioned coaxially to one another and shaped on the inside as double cones with an optimized cross-section course; therefore they exhibit areas with a widened cross-section at both ends.

In order to ensure an axial spacing of the nozzles from one another and the creation of a defined slit for the suction gas intake 24A, 24B between pressure gas nozzle 18A and diffuser 18B, and diffusers 18B and 18C, respectively, one piece spacers 22A and 22B are provided between pressure gas nozzle 18A and diffuser 18B, and diffusers 18B and 18C. The spacers, as shown in FIG. 2, are finger-shaped and eccentrically positioned between pressure gas nozzle 18A and diffuser 18B, and diffusers 18B and 18C. These spacers form slender extensions on one place of the circumference in the area of the front surface of the diffusers. The spacers interfere little with the entry of the suction gas on the suction gas intake slit 24A and 25A between adjacent the nozzle and diffusers, because the spacers are located in the areas where the gas flow is less, far from the suction chambers 26A and 26B. In the operating position of the individual nozzles as shown in FIGS. 1 and 2, spacers 22A, 22B are supported on the adjacent nozzle front wall 18A' or 18B'.

Nozzle 18A and diffusers 18C are secured by means of positioning nozzle 18A and diffusers 18B and 18C in nozzle-receiving shaft 14 and securing nozzle 18A and diffusers 18B and 18C in the nozzle-receiving shaft 14 by a connection plate 28 screwed on the front of housing element 10. In the nozzle-receiving shaft, nozzle 18A and diffusers 18B and 18C are clamped axially against one another or held in position by means of spacers 22A, 22B. Connection plate 28 includes threaded drilled holes 28A, 28B for mating with Pressure gas connection and exhaust gas connection.

Figure 3:
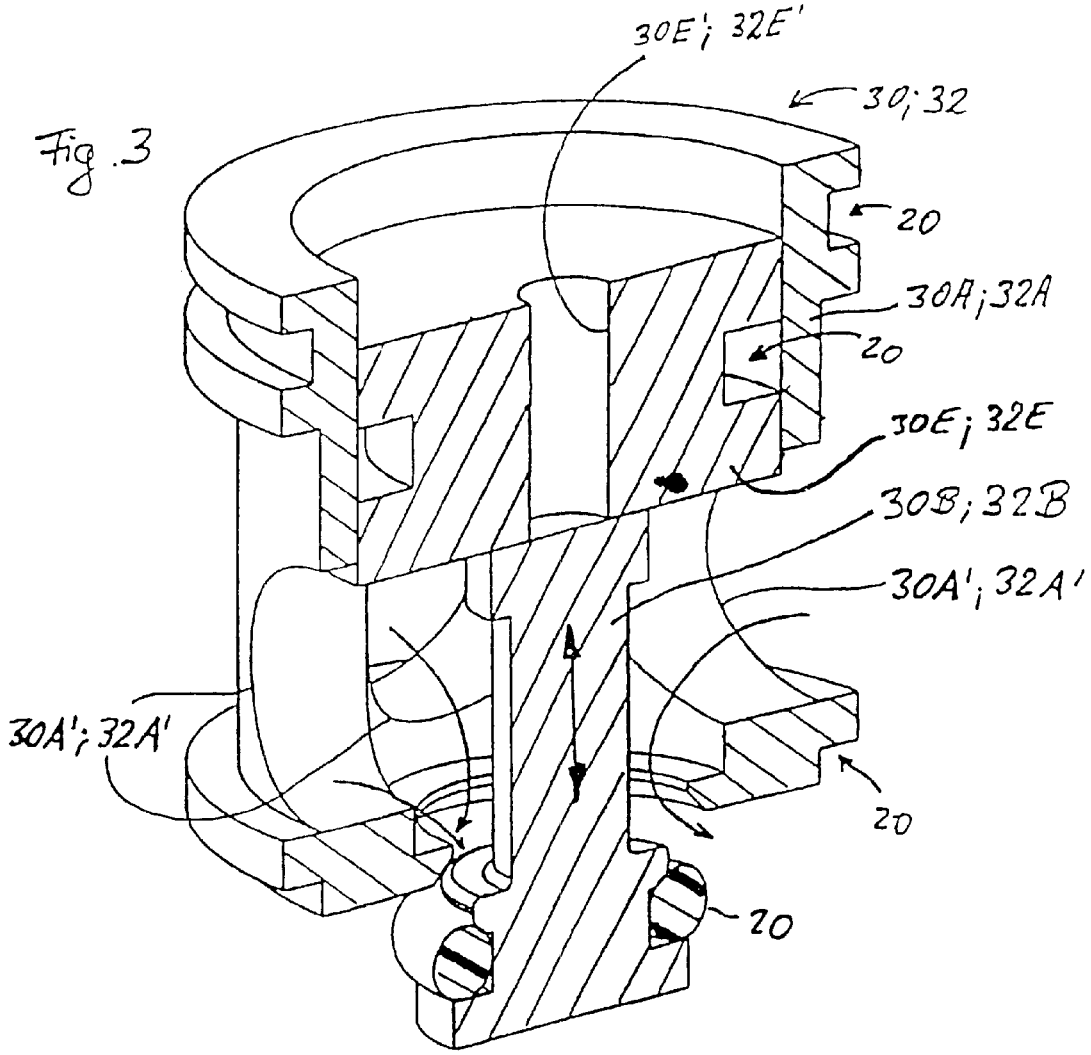

The supply of the pressure gas into the housing element is regulated by control valves 30, 32. These valves are inserted with O-rings 20 into tiered drilled holes 30C and 32C to receive the valves. These valve-receiving drilled holes extend out from one upper lateral wall 10A of the housing element 10 into the nozzle-receiving shaft 14. The control valves are comprised of a transversally interrupted guide sleeve 30A or 32A and a valve tappet 30B or 32B with tightening pistons 30E or 32E. As can be seen from FIG. 3, valve tappets 30B, 32B and tightening pistons 30E, 32E initially form separate components so that they, because of their different diameter, can be used and inserted from opposite sides into the guide sleeve 30A, 32A. A tap date (not shown) of the valve tappet 30B, 32B can be inserted into a central drilled hole 30E', 32E' of the tightening piston 30E, 32E, for the purpose of connecting the two parts, for example by screwing them together. A valve plate 34 located on lateral wall 10A of the housing element 10, is subject to sufficient pressure so form a hermetical seal. The valve plate includes two pairs of drilled passage holes 36A, 36B and 38A, 38, which connect the inside of the drilled hole 12 for the pressure gas and the valve tappets 30B or 32B with electromagnetic switch valves 36 or 38. These switch valves 36, 38, are controlled electrically and they either open or close the flow path for which they are constructed. The back and forth movement of the valve tappets 30B and 32B takes places pneumatically, corresponding to the gas pressures exerted on the valve tappets, depending on whether switch valve 36 or 38 is open or closed. This takes space, taking into account the differing piston surfaces on the upper side and the tappet side of the tightening pistons 30E, 32E.

Control valve 30 is shown in its open position in FIG. 1. In this open position, the pressure gas path, as shown by the flow arrows, flows through nozzle 18A, and diffusers 18B and 18C. Control valve 32 is closed at this time because a vacuum should be created and held. As soon as sufficient vacuum is attained, control vale 30 may be closed to save energy. To accelerate the elimination of the vacuum that has been produced control valve 32 may be opened at the end of the working cycle. When this is done, pressure gas flows over conduits 32D (shown by a broken line in FIG. 1) that runs inside the housing element 10 to suction connection 40A of a vacuum connection block 40. This block is tightly screwed onto the rear wall 10D of the housing element 10 so that the vacuum connection clock 40 is hermetically sealed with housing element 10. The vacuum connection block houses a vacuum monitoring switch 40B. This space-saving positioning of control valves 30 and 32 is made possible by drilled holes 30A', 32A' of guide sleeves 30A, 32A in the area of the drilled hole 12 for the pressure gas.

Suction chambers 26A and 26B are separated from one another by the flap valves 26B a 26C that are inserted into the drilled hole for the suction gas so that the flap valves are hermetically sealed in the drilled hole for the suction gas. The flap valves have the known effect of attaining the desired vacuum more quickly and at a higher efficiency of use of the pressure air and/or energy.

Suction chambers 26A and 26B are connected with annular gap spaces in the area of the suction gas intake slits 24A and 25A by connection openings 16C and 16D that run at an angle to the drilled hole 16 for the suction gas with the nozzle receiving shaft 14. In order to utilize this configuration, the lateral wall 10B of the housing element, located opposite switch valves 36 and 38, includes a drilled cross hole that can be closed by means of welsh plugs 16E and 16F.

A multi-stage ejector pump, from its core outward, therefore is comprised of a flat rectangular housing element 10 that serves as the ejector block, with three drilled holes 12, 14, and 16 running essentially parallel to one another in the same direction as the housing element and also drilled connection holes 30C, 32C, 16C, and 16D running in a second direction at a right angle of the housing element, while the front, lateral, and rear walls 10A through 10D contain the mouths of the drilled holes are screwed tight to the connection plates 28, 34 and 40 so as to be hermetically sealed or closed with welsh plugs 16E, 16F.

The mode of functioning of this highly compact arrangement can be inferred, on one hand, from the above described individual explanations. In context, this means that, when the pressure air is connected to connection plate 28, control valves 30 and 32 are closed in a rest position, as are the corresponding switch valves 36 and 38. In order to initiate the production of the vacuum, switch valve 38 is opened. The opening of switch valve 28 opens the passage through the connecting drilled passage holes 38A and 38B. On account of the varying piston cross-section surfaces on the two sides of the valve tappet 30B, the tappet is pushed into its opening position and pressure air flows through the ejector nozzle conduit, while the suction air is being drawn off. The resulting vacuum is monitored by the vacuum monitoring switch 40B. If the vacuum is no longer needed, switch valve 38 is closed and is emptied of air on the outlet side, so that the valve tappet 30B goes back into the closed position. Should the elimination of the vacuum have to be actively supported, switch valve 36 is opened by electromagnetic means and thereby control valve 32 is pneumatically opened, so that pressure air reaches the vacuum connection 40A.

The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention.

I claim:

1. A multi-staged ejector pump comprising a housing element and a nozzle arrangement, said housing includes a pressure gas conduit having an opening in a face of said housing, a suction gas conduit having an opening in a face of said housing, and an exhaust conduit having an opening in a face of said housing, at least two of said pressure gas conduit, said suction gas conduit, or said exhaust gas conduit in a substantially parallel relationship to one another, said nozzle arrangement includes a first and second nozzle positioned coaxially in said exhaust gas conduit, said first and second nozzle includes at least one support element to reduce movement to said first and second nozzle in said exhaust gas conduit, wherein said nozzle arrangement includes at least one spacer positioned between said first and second nozzle, said spacer includes a central opening adapted to allow axial flow of a fluid between said first and second nozzles and a side opening adapted to allow fluid flow in a non-axial direction.

2. The pump as defined in claim 1, wherein at least two of said openings in said pressure gas conduit, said suction gas conduit, or said exhaust gas conduit are in the same face of said housing.

3. The pump as defined in claim 2, wherein said opening of said pressure gas conduit and said exhaust gas conduit in the same face of said housing and said opening of said suction gas conduit in a different face of said housing.

4. The pump as defined in claim 2, wherein said first and second nozzles include a front end and back end, said back end having a cross-sectional area that is less than said front end.

5. The pump as defined in claim 4, wherein said support arrangement includes a sealing ring, said sealing ring at least partially positioned in a groove on said front end of said first and second nozzles.

6. The pump as defined in claim 5, including a clamp plate detachably connected to a face of said housing, said clamping plate securing said nozzle arrangement in said exhaust gas conduit when connected to said face of said housing.

7. The pump as defined in claim 6, including at least one flap valve positioned in said suction gas conduit, said flap valve inhibiting fluid flow out of said opening of said suction gas conduit.

8. The pump as defined in claim 7, including a vacuum connection block releaseably connected to a face of said housing, said vacuum connection block reducing a range of movement of said at least one flap valve in said suction gas conduit.

9. The pump as defined in claim 6, wherein said suction gas conduit includes a first and a second cross-section area that are different in size.

10. The pump as defined in claim 9, wherein said exhaust gas conduit includes a first, a second, and a third cross-section area that are different in size.

11. The pump as defined in claim 10, wherein said exhaust gas conduit includes at least one side opening between said pressure gas conduit and said exhaust gas conduit, and at least one side opening between said suction gas conduit and said exhaust gas conduit.

12. The pump as defined in claim 11, including at least one control valve at least partially positioned in said side opening between said exhaust gas conduit and said pressure gas conduit, said control valve at least partially controlling fluid flow between said exhaust gas conduit and said pressure gas conduit.

13. The pump as defined in claim 12, wherein said pressure gas conduit includes at least one lateral opening between said pressure gas conduit and a face of said housing, said lateral opening oriented substantially transverse to a longitudinal axis of said pressure gas conduit, said control valve at least partially positioned in said lateral opening.

14. The pump as defined in claim 1, wherein said first and second nozzles include a front end and back end, said back end having a cross-sectional area that is less than said front end.

15. The pump as defined in claim 14, wherein said support arrangement includes a sealing ring, said sealing ring at least positioned in groove on said front of said first and second nozzles.

16. The pump as defined in claim 14, wherein said front end of said first nozzle having substantially the same shape and size as said back end of said second nozzle.

17. The pump as defined in claim 1, wherein said housing is substantially cubic-shaped, said housing including a light material or plastic.

18. The pump as defined in claim 1, wherein said support arrangement include a sealing ring.

19. The pump as defined in claim 1, wherein said exhaust gas conduit includes at least one side opening between said pressure gas conduit and said exhaust gas conduit, and at least one side opening between said suction gas conduit and said exhaust gas conduit.

20. The pump as defined in claim 19, wherein said side openings in said exhaust gas conduit are oriented substantially transverse to a longitudinal axis of said exhaust gas conduit.

21. The pump as defined in claim 20, including at least one control valve at least partially positioned in said side opening between said exhaust gas conduit and said pressure gas conduit, said control valve at least partially controlling fluid flow between said exhaust gas conduit and said pressure gas conduit.

22. The pump as defined in claim 21, wherein said pressure gas conduit includes at least one lateral opening between said pressure gas conduit and a face of said housing, said lateral opening oriented substantially transverse to a longitudinal axis of said pressure gas conduit, said control valve at least partially positioned in said lateral opening.

23. The pump as defined in claim 1, including at least one control valve at least partially positioned in said side opening between said exhaust gas conduit and said pressure gas conduit, said control valve at least partially controlling fluid flow between said exhaust gas conduit and said pressure gas conduit.

24. The pump as defined in claim 23, wherein said control valve includes a piston having a first and second face, said first face having a cross-sectional area that is greater than a cross-sectional area of said second face.

25. The pump as defined in claim 23, wherein said pressure gas conduit includes a switch valve and at least one control opening between said pressure gas conduit and a face of said switch valve, said switch valve controlling said control valve.

26. The pump as defined in claim 25, wherein said control valve includes a piston having a first and second face, said first face having a cross-sectional area that is greater than a cross-sectional area of said second face.

27. The pump as defined in claim 23, wherein said pressure gas conduit includes at least one lateral opening between said pressure gas conduit and a face of said housing, said lateral opening oriented substantially transverse to a longitudinal axis of said pressure gas conduit, said control valve at least partially positioned in said lateral opening.

28. The pump as defined in claim 1, wherein said side opening of said spacers allow fluid flow between said suction gas conduit and said nozzle arrangement in said exhaust gas conduit.

29. The pump as defined in claim 28, wherein said spacers are not connected to said first or second nozzle.

30. The pump as defined in claim 1, wherein said spacers are not connected to said first or second nozzle.

31. The pump as defined in claim 1, including a clamp plate detachably connected to a face of said housing, said clamping plate securing said nozzle arrangement in said exhaust gas conduit when connected to said face of said housing.

32. The pump as defined in claim 1, including at least one flap valve positioned in said suction gas conduit, said flap valve inhibiting fluid flow out of said opening of said suction gas conduit.

33. The pump as defined in claim 32, wherein said at least one flap valve insertable and removable through said opening of said suction gas conduit.

34. The pump as defined in claim 33, wherein a plug inserted into a face of said housing reduces a range of movement of said at least one flap valve in said suction gas conduit.

35. The pump as defined in claim 32, wherein a plug inserted into a face of said housing reduces a range of movement of said at least one flap valve in said suction gas conduit.

36. The pump as defined in claim 1, including a vacuum connection block releaseably connected to a face of said housing, said vacuum connection block reducing a range of movement of said at least one flap valve in said suction gas conduit.

37. The pump as defined in claim 1, wherein said suction gas conduit includes a first and a second cross-section area that are different in size.

38. The pump as defined in claim 37, wherein said exhaust gas conduit includes a first, a second, and a third cross-section area that are different in size.

39. The pump as defined in claim 1, wherein said exhaust gas conduit includes a first, a second, and a third cross-section area that are different in size.

40. The pump as defined in claim 1, wherein said first and second nozzles are insertable and removable through said opening of said exhaust gas conduit.

41. A multi-stage ejector pump comprising a housing element and a nozzle arrangement, said housing includes a pressure gas conduit having an opening in a face of said housing, a suction gas conduit having an opening in a face of said housing, and an exhaust conduit take having an opening in a face of said housing, said nozzle arrangement includes a first, second and third nozzles and first and second spacers positioned coaxially in said exhaust gas conduit, said first, second and third nozzles include at least one support element to reduce movement of said first and second nozzle in said exhaust gas conduit, said first spacer positioned between said first and second nozzle, said second spacer positioned between said second and third nozzle, each of said spacers includes a central opening adapted to allow axial flow of a fluid between said first and second nozzles and said second and third nozzles, each of said spacers includes a side opening adapted to allow fluid flow in a non-axial direction, side opening of said spacers allow fluid flow between said suction gas conduit and said nozzle arrangement in said exhaust gas conduit.

42. The pump as defined in claim 41, wherein said support arrangement includes a sealing ring, said sealing ring at least partially positioned in a groove on a front end of said first, second and third nozzles.

43. The pump as defined in claim 41, wherein at least two of said pressure gas conduit, said suction gas conduit, or said exhaust gas conduit in a substantially parallel relationship to one another.

44. The pump as defined in claim 41, wherein said openings in said pressure gas conduit and said exhaust gas conduit are in the same face of said housing.

45. The pump as defined in claim 41, wherein said first, second and third nozzles include a front end and back end, said back end having a cross-sectional area that is less than said front end.

46. The pump as defined in claim 41, wherein said spacers are not connected to said first, second or third nozzle.

47. The pump as defined in claim 41, including a clamp plate detachably connected to a face of said housing, said clamping plate securing said nozzle arrangement in said exhaust gas conduit when connected to said face of said housing.

48. The pump as defined in claim 41, including at least one flap valve positioned in said suction gas conduit, said flap valve inhibiting fluid flow out of said opening of said suction gas conduit, said flap valve insertable and removable through said opening of said suction gas conduit.

49. The pump as defined in claim 48, wherein a plug inserted into a face of said housing reduces a range of movement of said at least one flap valve in said suction gas conduit.

50. The pump as defined in claim 49, including a vacuum connection block releaseably connected to a face of said housing, said vacuum connection block reducing a range of movement of said at least one flap valve in said suction gas conduit.

51. The pump as defined in claim 41, wherein said suction gas conduit includes a first and a second cross-section area that are different in size, said exhaust gas conduit includes a first, a second, and a third cross-section area that are different in size.

52. The pump as defined in claim 41, wherein said first, second, and third nozzles and said first and second spacers are insertable and removable through said opening of said exhaust gas conduit.

53. The pump as defined in claim 41, wherein said exhaust gas conduit includes at least one side opening between said pressure gas conduit and said exhaust gas conduit, and at least one side opening between said suction gas conduit and said exhaust gas conduit, said side openings in said exhaust gas conduit are oriented substantially transverse to a longitudinal axis of said exhaust gas conduit.

54. The pump as defined in claim 53, including at least one control valve at least partially positioned in said side opening between said exhaust gas conduit and said pressure gas conduit, said control valve at least partially controlling fluid flow between said exhaust gas conduit and said pressure gas conduit.

55. The pump as defined in claim 54, wherein said pressure gas conduit includes at least one lateral opening between said pressure gas conduit and a face of said housing, said lateral opening oriented substantially transverse to a longitudinal axis of said pressure gas conduit, said control valve at least partially positioned in said lateral opening.

56. The pump as defined in claim 55, wherein said pressure gas conduit includes a switch valve and at least one control opening between said pressure gas conduit and a face of said switch valve, said switch valve controlling said control valve.

57. The pump as defined in claim 56, wherein said control valve includes a piston having a first and second face, said first face having a cross-sectional area that is greater than a cross-sectional area of said second face.

* * * * *